US011802099B2

(12) United States Patent
Lewtas et al.

(10) Patent No.: US 11,802,099 B2
(45) Date of Patent: Oct. 31, 2023

(54) OR RELATING TO ENERGETIC MATERIALS

(71) Applicant: Lewtas Science & Technologies Ltd, Oxford (GB)

(72) Inventors: Kenneth Lewtas, Oxford (GB); Daniel Jubb, Astley (GB); Mark Price, Oxford (GB)

(73) Assignee: LEWTAS SCIENCE & TECHNOLOGIES LTD, Oxford (GB)

( * ) Notice: Subject to any disclaimer, the term of this patent is extended or adjusted under 35 U.S.C. 154(b) by 117 days.

(21) Appl. No.: 15/767,547

(22) PCT Filed: Oct. 12, 2016

(86) PCT No.: PCT/EP2016/074423
§ 371 (c)(1),
(2) Date: Apr. 11, 2018

(87) PCT Pub. No.: WO2017/064102
PCT Pub. Date: Apr. 20, 2017

(65) Prior Publication Data

US 2018/0305270 A1 Oct. 25, 2018

(30) Foreign Application Priority Data

Oct. 12, 2015 (GB) ..... 1518010

(51) Int. Cl.
*C06B 45/10* (2006.01)
*C06B 27/00* (2006.01)
(Continued)

(52) U.S. Cl.
CPC ..... *C06B 45/10* (2013.01)

(58) Field of Classification Search
CPC ..... C06B 29/00; C06B 29/22; C06B 27/00; C06B 45/10
(Continued)

(56) References Cited

U.S. PATENT DOCUMENTS 5,712,511 A * 1/1998 Chan ..... C06B 25/34 241/1
6,740,180 B1 * 5/2004 Cesaroni ..... C06B 45/10 149/19.91
(Continued)

FOREIGN PATENT DOCUMENTS

CN 103951534 A 7/2014
GB 876951 A 9/1961
(Continued)

OTHER PUBLICATIONS

International Search Report and Written Opinion from the European Patent Office for Application No. PCT/EP2016/074423 dated Dec. 21, 2016.
(Continued)

*Primary Examiner* — James E McDonough
(74) *Attorney, Agent, or Firm* — The Dobrusin Law Firm, P.C.

(57) ABSTRACT

Energetic materials comprising active components, a polymer binder matrix and a tackifying resin are useful as propellants; fuels, pyrotechnic materials and explosives; the tackifying resin improves the adhesion and dispersion of the active components throughout the binder resin.

20 Claims, 8 Drawing Sheets

(51) Int. Cl.
*C06B 29/22* (2006.01)
*C06B 29/00* (2006.01)

(58) Field of Classification Search
USPC ..... 149/75, 76, 87
See application file for complete search history.

(56) References Cited

U.S. PATENT DOCUMENTS

2001/0021737 A1* 9/2001 Hazen ..... C09J 167/08 524/502
2014/0260185 A1 9/2014 Seidner et al.

FOREIGN PATENT DOCUMENTS

GB 2166128 A 4/1986
GB 2365420 A 2/2002
GB 2507459 A 5/2014
JP S57-196788 A 12/1982
JP S57-196789 A 12/1982

OTHER PUBLICATIONS

K. Kunal et al. "Polyisobutylene: A Most Unusual Polymer", Journal of Polymer Science Part B: Polymer Physics, vol. 46, No. 13, Jul. 1, 2008 (Jul. 1, 2008), pp. 1390-1399.
International Preliminary Report on Patentability from the European Patent Office for Application No. PCT/EP2016/074423 dated Jan. 17, 2018.
H.G. Ang, S. Pisharath, "Energetic Polymers: Binders and Plasticizers for Enhancing Performance", First Edition 2012, https://application.wiley-vch.de/books/sample/3527331557_c01.pdf.
Pinova, Inc., "Product Data Sheet Foral ® 105 Synthetic Resin", pinovasolutions.com, Available from: http://harwick.com/files/tds/FORAL_105.PDF accessed Dec. 6, 2021.
Eastman, Technical Data Sheet, Foral ™ 105-E Ester of Hydrogenated Resin, accessed Jun. 9, 2020.

* cited by examiner

OR RELATING TO ENERGETIC MATERIALS

FIELD

The present invention relates to improvements to energetic materials and to the improved energetic materials and to material for use in the production of energetic materials.

BACKGROUND

Energetic materials are materials that contain a high amount of stored chemical energy that can be realised. Typical classes of energetic materials are propellants such as rocket propellants, oxidizers, fuels and explosives and they are materials that can undergo, contribute to or cause rapid exothermic decomposition, deflagration or detonation. These materials include chemical compounds or mixtures thereof that when subject to heat, impact, friction, detonation or other forms of initiation undergo a rapid chemical change with the evolution of large volumes of gasses, usually heated gasses that exert pressures in the surrounding medium.

SUMMARY

Energetic materials can take various forms and the present invention is applicable to many different forms of energetic materials. For example the invention is applicable to propellants that may be hybrid propellants or solid propellants, pyrotechnic materials and explosives.

A hybrid Propellant is at least two components one of which is stored in the liquid phase (usually the oxidizer, which can be cryogenic, e.g. liquid oxygen or non-cryogenic, e.g. hydrogen peroxide) and the other component is in the solid phase (e.g. cross-linked hydroxyl-terminated polybutadiene (HTPB)).

Pyrotechnic Material includes explosive or chemical ingredients, including powdered metals, used in the manufacture of pyrotechnic devices which includes all devices and assemblies containing or actuated by propellants or explosives, with the exception of large rocket motors. Pyrotechnic devices include items such as initiators, ignitors, detonators, safe-and-arm devices, booster cartridges, pressure cartridges, separation bolts and nuts, pin pullers, linear separation systems, shaped charges, explosive guillotines, pyrovalves, detonation transfer assemblies (mild detonating fuse, confined detonating cord, confined detonating fuse, shielded mild detonating cord, etc.), thru-bulkhead initiators, mortars, thrusters, explosive circuit interruptors, and other similar items.

An example of a complete device that derives its thrust from ejection of hot gases generated from propellants carried in the vehicle is a rocket, the rocket motor being the portion of the complete rocket or booster that is loaded with solid propellant.

A Solid Propellant is a solid composition used for propelling projectiles and rockets and to generate gases for powering auxiliary devices. It can be a rubbery or plastic-like mixture of oxidizer, fuel and other ingredients that has been processed into a finished propellant grain. The term solid propellant is sometimes used to refer to the processed but uncured product or the individual ingredients, such as the fuel or the oxidizer.

There are two types of solid propellants that are commonly in use, viz. Double-base and Composite propellants. Double-base propellants are usually made from a homogeneous propellant grain such as nitrocellulose, into which liquid nitroglycerine is absorbed (usually plus additives). This material is a combined fuel and oxidizer. Composite propellants are a heterogeneous propellant grain with the oxidizer crystals (such as ammonium perchlorate (AP)) and a powdered fuel ((usually Aluminium) held together in a matrix of synthetic rubber (or plastic) binder (such as hydroxyl terminated polybutadiene (HTPB)). This mixture may be hardened by a curing agent.

DETAILED DESCRIPTION

Figure 1:
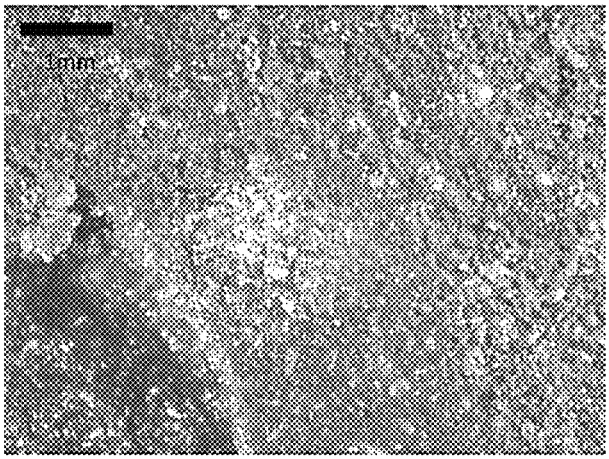
FIGS. 1 and 2 show the Resodyn Resonant Acoustic Mixer (RAM) and conventionally mixed samples of Formulation 1.

Polymer bonded energetic materials comprising an energetic filler material, usually in the form of a solid crystalline powder, formed into a consolidated mass having suitable mechanical properties and insensitivity by a polymeric binder. Such materials are well known and are used in a variety of military and civilian applications such as high explosives for use in demolition, welding, detonating, for example in mining applications, cutting charges and munition fillings, as propellants for guns and rockets, as gas generators and as pyrotechnics.

Binders used in polymer bonded energetic materials need to be (amongst other things) compatible with the other ingredients of the material and suitably processed together with the other ingredients into the appropriate shapes required in the various applications.

Polymeric binders may be classified generally into chemically cured materials and thermoplastic materials. Chemically cured materials, e.g. thermosetting resins, rely on the chemical reaction between different components to provide the desired polymeric structure.

Thermoplastic binders allow energetic materials containing them to be processed at elevated temperatures, usually outside the in-service envelope of the end product, which cool to give dimensionally stable sheet, bars, cylinders and other shapes. Reject materials may be re-cycled by reheating. This may not normally be achieved with materials based on chemically cured binders. Where thermoplastic materials are used we prefer that they have a number average molecular weight (Mn) of 20,000 or greater in order to provided sufficient strength to the energetic material.

The polymer or polymers used may have functional terminations or functional pendant groups. For example, the polymers may be carboxyl terminated, hydroxy terminated, amino terminated or vinyl terminated. Alternatively, the polymer may be non-functionally terminated. Note that "terminated, termination, etc." here means that it is accessible for further cross-linking reactions and can be at the ends of the polymer chains or at other parts of the polymer chain off pendant chain or branch points.

As mentioned above, polymeric binders for solid composite propellants (which can also include explosives and pyrotechnics) are of two main types, viz. cured (cross-linked) polymers and thermoplastic polymers.

Chemically cross-linked systems need functional points of attachment at the ends and/or along the polymer chain with which to react and form an immobile but flexible network-like structure in which to embed and bind the energetic material particles. The cross-linking may occur by adding a separate cross-linking agent (e.g. a multi-isocyanate, e.g. isophorone diisocyanate, to an hydroxyl containing polymer, e.g. hydroxyl-modified polybutadiene). It is preferable to add the tackifying resin, which is the subject of this invention prior to cross-linking the polymer system. The resulting polymer-resin blend may be stored and transported as a complete system of any desirable concentration used as a total component and possibly diluted with the neat polymer as the application demands.

Thermoplastic binders do not need chemical cross-linking. They form physical "cross-links" as the temperature is lowered from the polymer melt. A physical type of "cross-linking" occurs by the association and immobilisation of the polymer chains by two types of mechanisms. One type is crystallisation, in which segments of the polymer chains associate and form crystal domains which effectively physically "cross-link" the system into a flexible solid. Care must be taken not to have too many and/or too big crystalline domains because this would make the resulting solid hard and brittle. The other type is formed by the association of amorphous polymer segments with a higher glass transition temperature (Tg) than other segments of the polymer (which remain above their Tgs at the operating temperatures). The polymer is heated above the highest Tg and then cooled. The highest Tg segments associate and form domains which effectively physically "cross-link the polymer system onto a flexible solid. Examples of such polymers are styrenic-block copolymers such as polystyrene-polyethylene/butene block polymers. It is preferable to add the tackifying resin, which is the subject of this invention prior to cooling the polymer system below the highest Tg. The resulting polymer-resin blend may be stored and transported as a complete system of any desirable concentration used as a total component and possibly heated and diluted with the neat polymer as the application demands.

Some of these polymers may also be energetic materials in their own right.

Polymers comprising acrylonitrile/carboxyl terminated butadienes may include as copolymerized monomer units optionally substituted alkyl chains, eg. dimethylene optionally substituted with a carboxyl group. Carboxyl terminated acrylonitrile/butadiene copolymers and hydroxy terminated polybutadiene have been found to be particularly useful.

The present invention is concerned with improving one or more of the processing, storage, transportation, safety, physical and mechanical properties and the end use of energetic materials.

The energetic materials typically comprise one or more active components which can be activated by energy input, e.g. heat, impact, agitation as is required according to the particular use envisaged for the energetic material. In the final composition the active components are usually bound together within a matrix of a polymer binder. Various polymers have been proposed as binders, polyisobutylene is one well known binder although the currently preferred binder is cross-linked hydroxyl terminated polybutadiene.

The performance of these energetic materials including their processing and the energy generated per unit of the active components can depend upon the distribution of the active components throughout the matrix of the polymer binder. We have found that the performance may be significantly improved if a tackifying resin is included in the energetic material formulation.

The present invention therefore provides an energetic material formulation containing a tackifying resin.

UK patent Application GB 2365420 relates to plastic mouldable explosive compositions comprising a gelled binder and a particulate explosive filler contained in the binder, the binder being a blend of polyethylene wax polymer together with a polyisobutylene polymer which is described as a tackifying resin. The use of the blend as the binder is said to show reduced migration of the liquid binder components (and hence brittleness) with exudation compared with the use of liquid paraffin gelled to form a grease as a binder.

The term tackifying resin has several meanings. Polyisobutylene is a sticky material with a Tg below −80° C. typically between −100° C. and −90° C. and is used in GB 2365420 to ensure adhesion between the materials of the formulation. Polyisobutylene is incompatible with polyethylene.

In this invention the term tackifying resin is used to describe a material that is compatible with the polymeric binder that is used in the formulation. The tackifying resin should be compatible with the polymeric binder and the integrity of the blend of the polymeric binder and the tackifying resin in the resin should be maintained over a temperature range of −60° C. to 150° C. or higher perhaps up to 200° C. In order for this to be achieved the tackifying resin used in this invention preferably has a Tg in the range −70° C. to +200° C., preferably −50° C. to +150° C., most preferably −20° C. to +130° C.

In a further embodiment the invention provides an energetic material formulation comprising i) one or more active components ii) a polymeric binder matrix iii) a tackifying resin The formulations typically can also contain cross linking agents (curing agents) for the polymeric binder matrix.

In a further embodiment the invention provides the use of a tackifying resin to improve the adhesion and dispersion of one or more active components within the polymer matrix of an energetic material.

The invention further provides a blend of a polymer matrix and a tackifying resin as described herein useful as a binder for active ingredients of energetic materials.

The tackifying resins used in the present invention are largely amorphous materials of low molecular weight (e.g. 400-2000) with relatively high (but variable) glass transition temperatures (Tg) above −70° C. and preferably in the range −70° C. to +200° C. as set out above. Unlike the polyisobutylene used in GB 2365420 they are known to be used as additives in polymers where they are compatible with the polymer and decrease the degree of entanglement of the polymers they are added to and thus affect the formulation rheology (lowering of plateau modulus) and final properties (adhesive tack and adhesive strength and elongation).

Tackifying resins that can be used in this invention are well known and may be derived from natural materials such as Tall Oil Rosin Esters or they may be synthetic resins such as the hydrocarbon resins derived from hydrocarbon streams obtained in the cracking of petroleum products. These synthetic resins may be aliphatic, aromatic or aliphatic/aromatic and, in the case of synthetic resins, are typically derived from C5 streams, C9 streams or mixtures thereof from refinery/chemical plant steam crackers.

Examples of suitable resins for use in this invention are rosin esters derived from rosin which may be converted to rosin ester. Three types of rosin are used for resin manufacture, gum rosin, wood rosin and tall oil rosin, and they are all generated from the pine tree.

Tall oil rosin is obtained by distillation of crude tall oil, a by-product of the kraft sulphate pulping process used in paper making. Crude tall oil typically contains 70-90% acidic material, which is composed essentially of fatty acid and tall oil rosin. Tall oil rosin (TOR) has a tendency to crystallize and usually contains 200-600 ppm sulfur. Highly distilled TOR can produce esters which have been found to be useful in this invention.

Rosin resins are typically a blend of the following different molecules.

Abietic Type

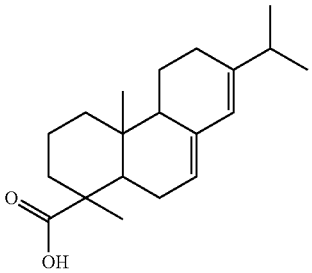

Abietic Acid

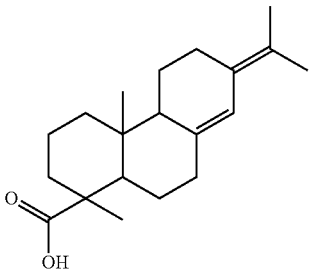

Neoabietic Acid

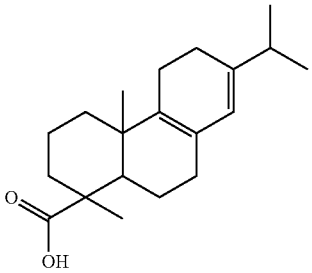

Palustric Acid

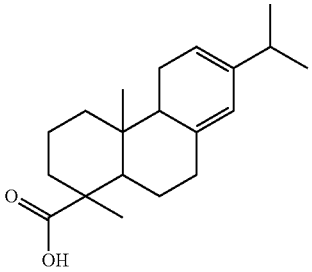

Levopimaric Acid

-continued

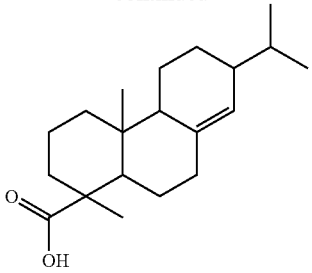

Dihydroabietic Acid

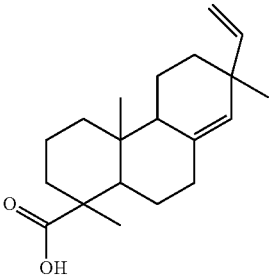

Pimaric Acid

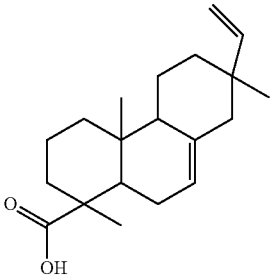

Isopimaric Acid

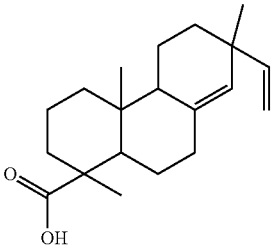

Sandaracopimaric Acid

Rosin molecules can have poor stability caused by unsaturation and stability can be improved by various methods such as disproportionation and hydrogenation.

Rearrangement of the double bonds by disproportionation leads to improved stability as shown below.

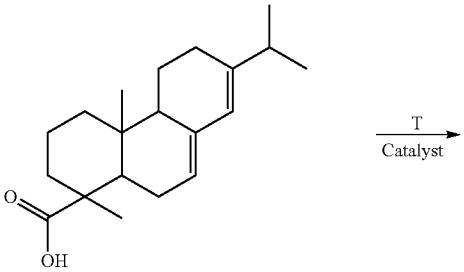

Abietic Acid

-continued

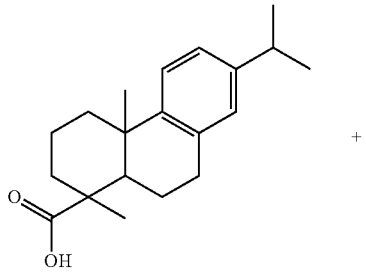

Dehydroabietic Acid

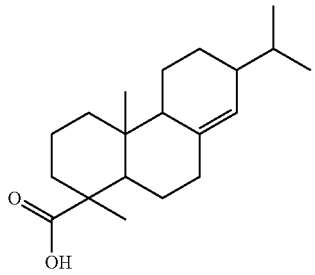

Dihydroabietic Acid

Another method to improve stability is to hydrogenate the rosin molecules as follows.

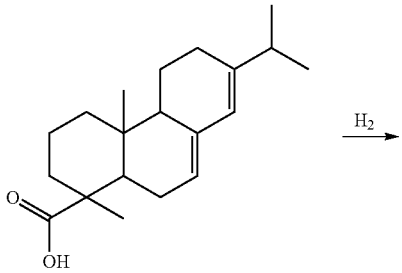

Abietic Acid

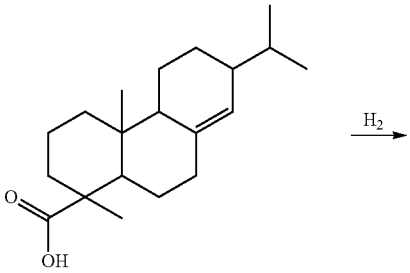

Dihydroabietic Acid

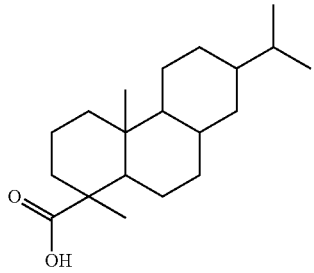

Tetrahydroabietic Acid

The carboxylic acid can be converted to an ester using various alcohols. The number of alcohol groups and molecular weight of the alcohol determines the softening point of the subsequent ester. Glycerol and pentaerythritol are the most commonly used alcohols. Methanol and tri-ethyleneglycol are used to produce lower softening point esters.

The esterification reaction is an equilibrium reaction, which is driven to near completion. However, there will always be some unreacted acidic and hydroxyl groups. A typical acid number for a pure rosin acid is around 170. A glycerol ester typically has an acid value below 20. The type of alcohol chosen is key to the molecular weight of the rosin ester and its softening point. Multi-alcohol compounds may be partially esterified, e.g. a mixture of mono-, di-, tri-, tetra-, etc. esters. A typical softening point for glycerol esters is 85° C., and 105° C. for pentaerythritol esters. The difference in softening point affects their compatibility and hence the softening point will be chosen according to the nature of the polymer binder in the energetic material.

Rosin resins have a wide span of compatibility with almost all polymers and they have been found to be particularly useful in the present invention.

Terpene resins are typically based on three natural feedstreams and are formed by a cationic polymerization reaction using a Lewis acid catalyst.

Terepenes such as alpha-pinene and beta-pinene are derived primarily from two processes: stump extraction leading to the isolation of steam distilled wood turpentine and the kraft sulfate pulping process leading to the isolation of sulfate turpentine. The individual terpene compounds are isolated by distillation from these two streams.

d-Limonene is obtained from citrus sources and a similar compound, dipentene, is obtained by distillation from petroleum sources.

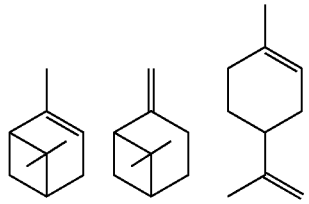

α-Pinene β-Pinene d-Limonene

There are other resins based on these terpene feedstocks:

Styrenated terpenes—mixed aliphatic/aromatic resins

Terpene phenolics—polar resins with excellent adhesion and broad compatibility with polar polymers.

Hydrogenated terpenes—improved colour by hydrogenation

These resins are also useful in the present invention.

Mixtures of these materials may be used in the synthesis of the final tackifying resin, e.g. terpenes can be added to hydrocarbon resins.

Hydrocarbon resins may also be used and there are five major types of hydrocarbon resins:

C5 aliphatic resins

C5/C9 aliphatic/aromatic resins

C9 aromatic resins

DCPD cycloaliphatic resins (dicyclopentadiene precursor)

DCPD/C9 cycloaliphatic/aromatic resins

The feedstocks to produce C5 and C9 hydrocarbon resins are usually fractions from a naphtha cracker or a steam cracker. The feed streams to produce hydrocarbon resins can be divided into two groups: C5 piperylene feedstock and C9 resin oil.

C5 piperylene feedstock contains one or more of the various monomers, illustrated below.

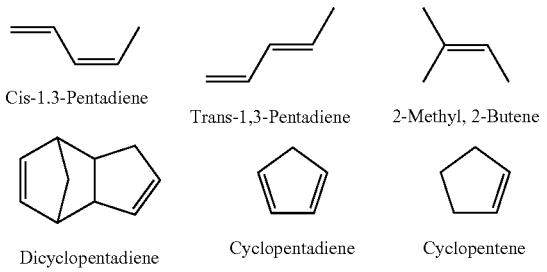

The liquid C5 feedstock can be polymerized to a solid resin using a Lewis acid catalyst (e.g. AlCl3 or BF3) and carefully selecting temperature and pressure to obtain the desired softening point and molecular weight.

C5 resins are, in essence, aliphatic materials. They are available in a wide range of softening points and molecular weights.

C9 Aromatic Hydrocarbon Resins

C9 resin oil contains various monomers as shown below.

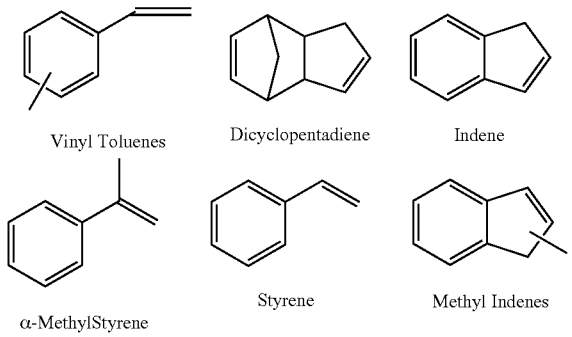

C9 resins are aromatic molecules. They are also available in a wide variety of softening points and molecular weights.

C5 and C9 resins can be modified by mixing the two feed streams together in certain ratios. This ratio determines the aliphatic/aromatic balance of the resin, which is essential to formulators.

The aliphatic C5 feed can be replaced with a terpene feedstock and modified with styrene to form "styrenated terpenes" which have excellent colour and stability.

Dicyclopentadiene (DCPD) feedstock contains various structures such as those shown below, but is primarily made up of dicyclopentadiene. The feed stock also contains codimers with dienes such as isoprene, butadiene and methylcyclopentadiene. At elevated temperature (170-190° C.), dicyclopentadiene will crack into cyclopentadiene.

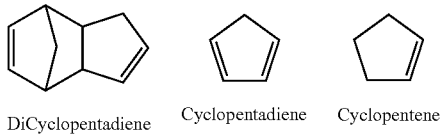

The thermal polymerization is thought to involve the Diels-Alder addition of cyclopentadiene to the norbornene olefin followed by continued additions of this type by additional cyclopentadiene to propagate the growing chain as shown below.

Cycloaddition of CPD to the norbornene ring of DCPD;

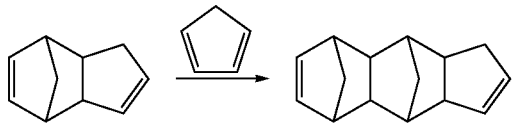

Cycloaddition of CPD to the growing chain

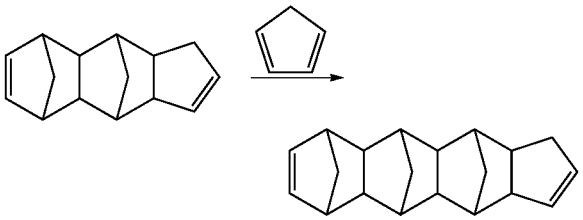

Further autocatalytic free-radical linking of these structures can extend the molecular weights. Aromatics, e.g. C9 stream, can be added to this material.

Dicyclopentadiene is polymerized either thermally or with a catalyst to form relatively dark and unstable resins with a characteristic odour. They are more commonly used as a base resin for subsequent hydrogenation to form water white resins with excellent stability and low odour. The hydrocarbon resins described above can be hydrogenated to produce another class of hydrocarbon resins. Hydrogenation is primarily used to improve colour and stability of the resin by removing vulnerable double bonds.

Partial and selective hydrogenation are methods used to produce resins with broad compatibility and good stability.

The most common base resins used for hydrogenation are as follows:

C9 and C9/C5 resins

DCPD and modified DCPD resins

C9 resins contain double bonds and have predominantly aromatic ring structures with an overall aromaticity, which are relatively unstable. Hydrogenation is a useful way to stabilize these resins. Resins can be hydrogenated in solution with very specific operating parameters: temperature, pressure, hydrogen concentration and catalyst level. Changing any one of these operating parameters will bring a change in the degree of hydrogenation of the final resin. During hydrogenation, the aromatic ring structures gradually lose their aromatic nature and become cyclo-aliphatic.

When the hydrogenation process is allowed to go to completion, the result is a fully hydrogenated hydrocarbon resin with full aliphatic character. The process can also be adjusted so that the resins are partially hydrogenated and still have some aromatic rings. The ability to be hydrogenated to varying degrees, resulting in various aliphatic/aromatic balances, gives these resins their unique properties. The resin can also control the burn rate of the energetic material particular the hydrocarbon resins.

Any of these tackifying resins may be used in the present invention. The choice of resin will depend upon the nature of the energetic material and also the nature of the polymer binder used in the formulation. Resins containing polar groups are preferred.

The energetic filler and the relative proportions of the components of the energetic material will depend upon the type of application for which the material is to be used.

The present invention may be used in for example a plastic bonded explosive in which the binder forms between 0.5 and 30% by weight and the energetic filler forms between 99.5 and 70% by weight. We prefer that ratio of polymeric binder matrix and tackifying resin in the energetic material be from 99:1 to 10:90, preferably from 95:5 to 20:80, more preferably from 90:10 to 40:60.

Examples of suitable energetic binder materials are nitrocellulose, polyvinyl nitrate, nitroethylene, nitroallyl acetate, nitroethyl acrylate, nitroethyl methacrylate, trinitroethyl acrylate, dinitropropyl acrylate, C-nitropolystyrene and its derivatives, polyurethanes with aliphatic C- and N-nitro groups, polyesters made from dinitrocarboxylic acids and dinitrotrodiols and nitrated polybutadienes.

Extenders may be used as part of the binder formulation to improve the processibility and flexibility of the product. For example, heavy grade liquid paraffin (up to 3% by weight of the binder formulation) may be employed in the binder.

The mixture of polymer binder matrix and tackifying resin is used at a ratio of 1:99 to 90:10 in relation to the total of the other components in the formulation. Preferably from 5:95 to 40:60 more preferably from 10:90 to 30:70.

Examples of active components (sometimes known as energetic fillers) to which this invention applies include organic secondary explosives. Alicyclic nitranes such as RDX (1,3,5-cyclotrimethylene-2,4,6-trinitramine) and HMX (1,3,5,7-cyclotetramethylene-2,4,6,8-tetraritramine) and TATND (tetranitro-tetraminodecalin) and mixtures thereof. The following active components may also be used as the main or as a subsidiary energetic component in plastic bonded explosives—nitroguanidine, aromatic nitramines such as tetryl, ethylene dinitramine, nitrate esters such as nitroglycerine, butanetriol trinitrate and PETN (pentaerythritol tetranitrate). Other nitroaromatic compounds such as trinitrotoluene (TNT) triaminobenzene (TATB) triaminotrinitro benzene (TATNB) and hexanitrostilbene may also be used.

Alternatively active components such as inorganic fillers such as ammonium nitrate and alkaline earth metal salts provide suitable high explosive materials. Metallic fuels such as powdered aluminium, magnesium or zirconium may be used to fuel the exothermic reaction of the oxidation of the energetic material. The metallic fuel may comprise up to 50% by weight of the energetic filler.

The energetic materials may alternatively comprise a gun propellant. In such a material the content of the active component is generally in the range 70 to 90% by weight of the binder/filler mixture and may be selected for example from nitroglycerine, RDX and HMX or a combination thereof, optionally with other highly active components such as those listed above. The binder of such a material may comprise in addition to the blend specified above a cellulosic material eg. nitrocellulose eg. forming from 5 to 95%, eg. 30 to 70% by weight of the binder.

The energetic material may alternatively comprise a gas generator material as the active component for example, for power cartridges for actuators: for base burning, reduced base drag, extended range projectiles: and for control gas jets for missile and projectile guidance systems and the like. Such material is similar in nature to a propellant, but in general contains a lower content of active component, eg. 45% to 65% by weight optionally together with a surface burning rate inhibitor, eg. ethyl cellulose.

As an example of a suitable rocket propellant embodying the invention the propellant composition may include as active component ammonium perchlorate (20 to 90% by weight) together with aluminium as fuel (5 to 50% by weight of its mixture with the active component), the binder forming for example 5 to 30% by weight of the composition together with the tackifying resin.

The energetic material may also comprise a polymer bonded pyrotechnic material, eg. containing an inorganic nitrate or perchlorate of ammonium, barium or strontium (forming 20 to 80% by weight of the energetic filler), a metallic fuel such as magnesium or zirconium (forming 5 to 60% by weight of the filler), the binder comprising 5 to 30% by weight of the overall composition.

Although the use of non-viscous plasticisers may be avoided by use of the polymer bonded energetic materials because the polymers can have a plasticising effect upon the polymer, non-viscous plasticisers may optionally be incorporated in low concentrations in the compositions according to the present invention. Additionally the use of the tackifying resin may avoid the need for plasticisers in the formulation.

Where plasticisers are used, common plasticisers which are dialkyl esters of phthalic, adipic and sebacic acids may be used as the optional plasticiser, eg. the plasticiser may comprise dibutyl phthalate, disobutyl phthalate, dimethyl glycol phthalate, dioctyl adipate or dioctyl sebacate preferably less than 10% by weight of the binder binder processibility.

In addition, or alternatively, energetic plasticisers such as BDNPAIF (bis-2-dinitropropylacetral/formal), bis-(2-fluoro-2,2-dinitroethyl) formal, diethylene glycol dinitrate, glycerol trinitrate, glycol trinitrate, triethylene glycerol dinitrate, trimethylolethane trinitrate butanetriol trinitrate, or 1,2,4-butanetriol trinitrate, may be employed in concentration less than 10% by weight of binder in the materials according to the present invention.

Examples of suitable additional inert or non-energetic binder materials are cellulosic materials such as the esters, eg. cellulose acetate, cellulose acetate butyrate, and synthetic polymers such as polyurethanes, polyesters, polybutadienes, polyethylenes, polyvinyl acetate and blends and/or copolymers thereof.

Various other minor additives may be added to the formulations of the present invention. Examples of material that may be used include surfactants and antifoam. Preferably, the additives content comprises no more than 10% by weight, desirably less than 5% by weight, of the overall energetic material composition.

For example in propellant and gas generator compositions the additive may for example comprise one or more stabilisers, eg. carbamite or PNTYIA (para-nitromethylaniline); and/or one or more ballistic modifiers, eg. carbon black or lead salts; and/or one or more flash suppressants, eg. one or more sodium or potassium salts, eg. sodium or potassium sulphate or bicarbonate. Other modifiers particularly for ballistics include iron oxide, catacene or butadiene.

Antioxidant in an extent of up to 1% by weight of the overall composition of the energetic materials may usefully be incorporate in the materials. Phenolic antioxidents such as 2,2'-methylene-bis (4-methyl-6-butyl) phenol has been found to be very suitable.

Coupling agents known per se, eg. in concentrations of up to 2% by weight of the overall composition weight, may be employed to improve adhesion between the binder and the active energetic components.

Preferably, where the energetic material according to the present invention is a plastic bonded explosive it contains the following components (in percentage parts by weight): RDX: 80-99.5%, preferably about 88%; binder: 20-0.5%, preferably about 12%; 0 to 1% antioxidant, the overall percentages (excluding further optional additives) adding to 100 in each case.

The formulations of the present invention may be processed into manufactured products by processes which are generally known per se. For example, for the manufacture of plastic bonded explosives the binder ingredients including the tackifying resin may be mixed together in a blender at temperatures of 80° C. to 140° C. and then added to the active component by a solventless process or a solvent lacquer process. Although, in some cases, it may be possible to blend the total formulation all together or in different orders depending on the mixing method used, making a pre-blend of the polymer binder and tackifying resin is the preferred method as polymer binder-tackifying resin compatibility/miscibility is important. The polymer-tackifying resin mixture should ideally be completely compatible/miscible and produce a clear mixture/solution. Although some incompatibility/immiscibility is acceptable providing the mixture is homogeneous throughout the volume. Where the formulation also contains a cross-linking agent for the polymer binder it is preferred that it be added after the polymer has been blended with the tackifying resin. All materials may be mixed simultaneously although this is not preferred. The pre-blend may be prepared in one location and provided to another location for the introduction of the active material and optionally the cross linking agent for the polymer.

In a solvent lacquer process, the binder tackifying resin mixture may be dissolved in an organic solvent at a moderately elevated temperature, eg. 40° C. to 80° C. and the active component is subsequently stirred into the solvent lacquer after cooling to about 20° C. to give a slurry. The slurry is then mixed under vacuum at an elevated temperature, eg. 50° C. to 90° C., preferably 75° C. to 90° C. In a solventless process for example, for the production of plastic bonded nitramines the required quantity of pre-dried active component is wetted with water or an aqueous solution and heated to an elevated temperature, eg. 80° C.-100° C. The binder tackifying resin mixture is then added to the active component and the components are mixed together at that temperature. Any water remaining in the composition is removed under vacuum.

Materials produced in the ways described above or in other known ways may, depending on the material composition and its intended use, be shaped into products in known ways. For example, the material may be pressed, moulded or cast into a desired shape eg. for use as blocks, sheet explosive or for filling of shells, warheads and the like. Alternatively, the material may be extruded in a known manner in a corotating twin screw extruder, and subsequently cooled. The latter technique is especially suitable for the manufacture of gun propellant materials, eg. stick or tubular propellants of known cross-sectional shape.

In summary, the energetic materials of the present invention may, depending upon their specific composition and properties, be used in any one or more of the following well known applications: (i) General demolition; (ii) Explosive welding; (iii) Active armour; (iv) Detonating cord; (v) Linear cutting charges; (vi) Shell fillings; (vii) Mine fillings; (viii) Grenade fillings; (ix) Shaped-charge warhead fillings; (x) rocket propellants and gas generator propellants.

The energetic material needs to be a stable system which can be handled, stored and transported. The conditions under which it should be stable will vary from one energetic material to another and according to the use to which the energetic material is to be put. However generally energetic materials need to be prepared, handled, stored and transported at temperature in the range from −50° C. to 71° C. or higher. We have found that the inclusion of the tackifying resin in the formulation increases the strength of the formulation as shown by stress/strain testing. The presence of the tackifying resin also increases the elasticity. The formulations are therefore more robust.

Prior to this invention the energetic materials have comprised the active material or materials dispersed within a polymer binder, such as the blend of polyethylene and polyisobutylene of GB 2365240 or other binders as described in https://application.wiley-vch.de/books/sample/3527331557_c01.pdf We have found that the inclusion of a tackifying resin in these formulations improves the adhesion and dispersion of the active material within the polymer binder. This results in a more homogeneous distribution of the active material within the polymer binder. This improved dispersion of the active ingredient reduces the energy required for the mixing of the formulation, increases the stability of the material (better mechanical properties, e.g. strength, elongation, etc. prevents damage and debonding on transport and in operation), and help increase density of the formulation.

The invention is illustrated by reference to the following Examples

Example 1

A polymer binder comprising hydroxyl-terminated polybutadiene (Trade name: Poly bd R-45HTLO) and a tackifying resin: Tall Oil Rosin Ester (TORE) (Trade name: Dercol PE 100) were blended together by stirring the mixture at 100° C. for 30 minutes. The materials are compatible and formed a clear and bright liquid which was stable for at least 7 months The formulations set out in Table 1 were then prepared.

TABLE 1

| | | Formulation | |
|---|---|---|---|
| Active Material: | Component: | 1 | 2 |
| Polymer Binder* | R45HTLO | 3.754 | 3.754 |
| Plasticizer | Dioctyl adipate | 1.131 | 1.131 |
| Fuel | Aluminium powder | 1.000 | 1.000 |
| Fuel | Zinc Powder | 0.500 | 0.500 |
| Burning rate modifier | $Fe_2O_3$ | 0.135 | 0.135 |
| Oxidiser | Double-ground ammonium perchlorate | 6.011 | 6.012 |
| Oxidiser | 90 um ammonium perchlorate | 12.020 | 12.022 |
| Curing agent** | ISONATE 143L modified MDI | 0.521 | 0.386 |

*Formulation 1 contains only R45HTLO and Formulation 2 contains a 90/10 (w/w) ratio of the previously prepared R45HTLO/TORE mixture.
**The amount of curing agent ISONATE 143L was reduced in Formulation 2 so that both formulations contained the same amount relative to the amount of R45HTLO.

The curing agent is provided to crosslink the Polymer Binder which is (qualitatively) a low viscosity polymer at room temperature which mixes with all the components. The polymer is then crosslinked so that the energetic material is set to form a fixed stable system which can be handled and stored at temperatures between −50° C. and over 100° C.

Example 2

Two more formulations were made which also contained a silicone-based anti-foaming agent (at 0.0035 based on normalized aluminium concentration of 1.0) and triethanolamine (0.0106 based on normalized aluminium concentration of 1.0). Formulation 3 was based on the conventional formulation based on Formulation 1. Formulation 4 was based on the tackifying resin.

These formulations were mixed together and cured using two types of mixing apparatus.

Resodyn Resonant Acoustic Mixer (RAM) which is relatively new low frequency, high-intensity mixing equipment. Acoustic energy is used to create a uniform shear field throughout the entire mixing vessel. The result is rapid fluidization and dispersion of material.

The Curative was added at start and the mixing conditions were as follows.

30 g, no vacuum, 2 minutes 0 g, vacuum (−45 kPa), 5 minutes 30 g, vacuum, 5 minutes Secondly another batch was mixed in a conventional impeller mixing using a Baker-Perkins dual planetary vertical mixer.

The mixing conditions were:

Mixing blades rotating at 11 rpm 10 min mixing, no vacuum 45 min mixing, vacuum (−45 kPa)

The curative, was added after the 10 min mixing under vacuum.

The mixture containing the tackifying resin (as per Formulation 2) produced a more consistent mixture (very even slurry) which was easier to work with than Formulation 1. Formulation 2 cured (cross-linked via urethane linkages) faster overall and more consistently. This may be explained by understanding that the tackifying resin decreases the entanglement density of the polymer allowing greater diffusion (and lowering the plateau modulus) and more efficient urethane reactions.

Figure 2:
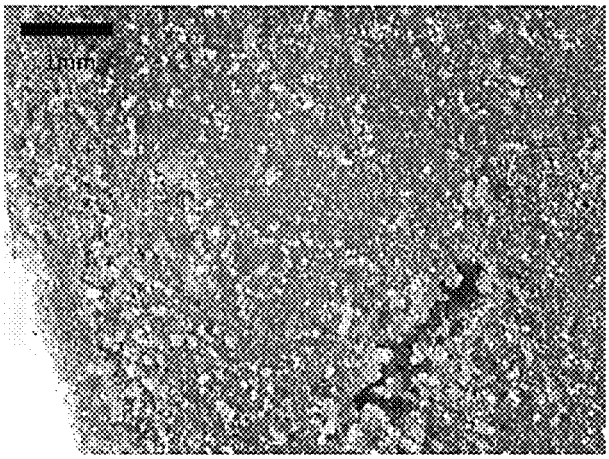
Figure 3:
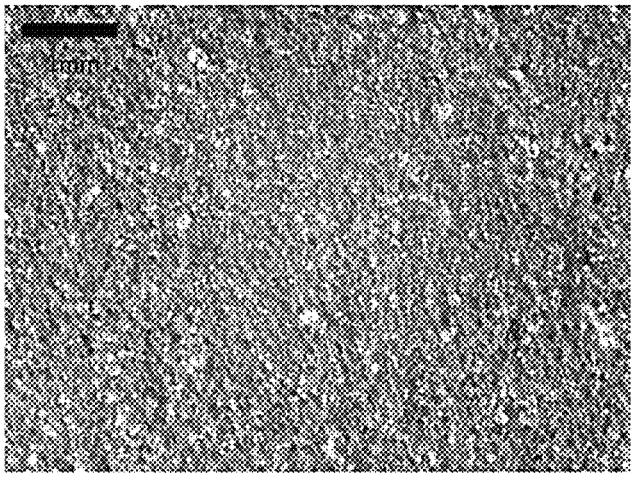
FIGS. 3 and 4 show the samples with tackifier resin of Formulation 2 using the same mixing techniques.
Figure 4:
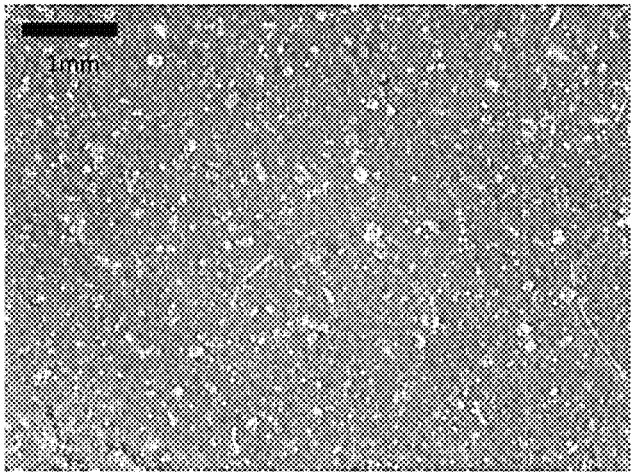

Macroscopic and microscopic examination of the finished materials (a highly filled, stiff rubber) showed that the mixture containing the tackifying resin (Formulation 2) was more consistent throughout the structure. The conventional sample (Formulation 1) was less homogenous in both RAM and conventional mixers than the formulation which is the subject of this invention (Formulation 2). FIGS. 1 and 2 show the RAM and conventionally mixed samples of Formulation 1. FIGS. 3 and 4 show the samples with tackifying resin (Formulation 2) using the same mixing techniques.

Figure 5:
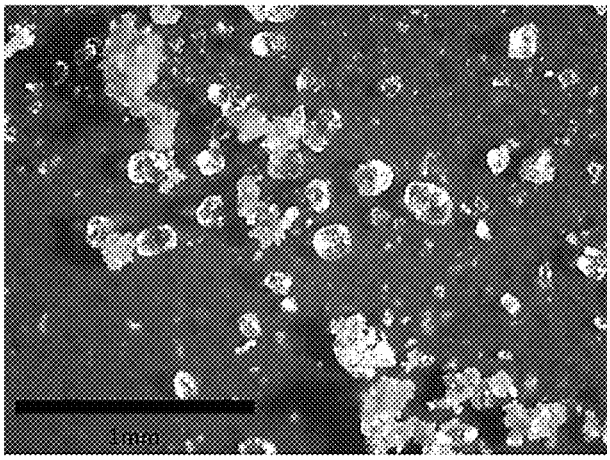
FIG. 5 shows Formulation 3 (no tackifier resin).
Figure 6:
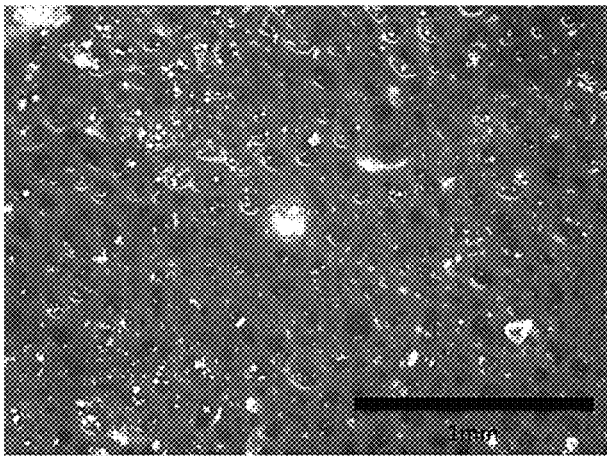
FIG. 6 shows Formulation 4 (with tackifier resin).

Formulations 3 and 4 show the same trends, i.e. the improvement in mixing, particle dispersion and adhesion of the binder to the other particles. After Formulations 3 and 4 were cast in polyethylene containers and fully cured they were examined by photomicroscopy. The top and bottom surfaces were examined. The sample was then sectioned and the cut surfaces examined. FIG. 5 shows Formulation 3 (no tackifying resin) and FIG. 6 shows Formulation 4 (with tackifying resin).

In all cases it was clear that the sample containing the tackifying resin improved dispersion of the active components and the adhesion of the polymer binder to the solid particulate matter (active components) in the formulation, especially the ammonium perchlorate.

Formulations 1 and 2 were moulded into tensile testing bars prior to complete crosslinking.

Tensile testing was performed on the conventionally mixed samples. The measurements were performed on a Shimadzu Tensile Tester with a 500N load cell.

The conventional sample (Formulation 1) did not extend the tensile bar at all. Failure occurred through cracking and minor fibrillation. The sample of this invention (Formulation 2) extended and showed an increased tensile strength.

Table 2 shows the tensile stress and strain measurements (average from 3 tensile bars) together with the standard deviations for Formulation 1 and Formulation 2. The percent improvement of Formulation 2 over Formulation 1 is also given (Table 2). The formulation containing the tackifying resin according to this invention is stronger (maximum stress), more elastic (4.26 v 5.13 N/mm2) and more extensible (maximum strain). The standard deviations show that it is also much more consistent.

TABLE 2

| | Max Stress ($N/mm^2$) | SD | Max Strain (mm) | SD |
|---|---|---|---|---|
| Formulation 1 | 0.109 | 0.023 | 3.0 | 0.5 |
| Formulation 2 | 0.250 | 0.005 | 7.7 | 0.3 |
| % Improvement | 129 | | 157 | |

Figure 7:
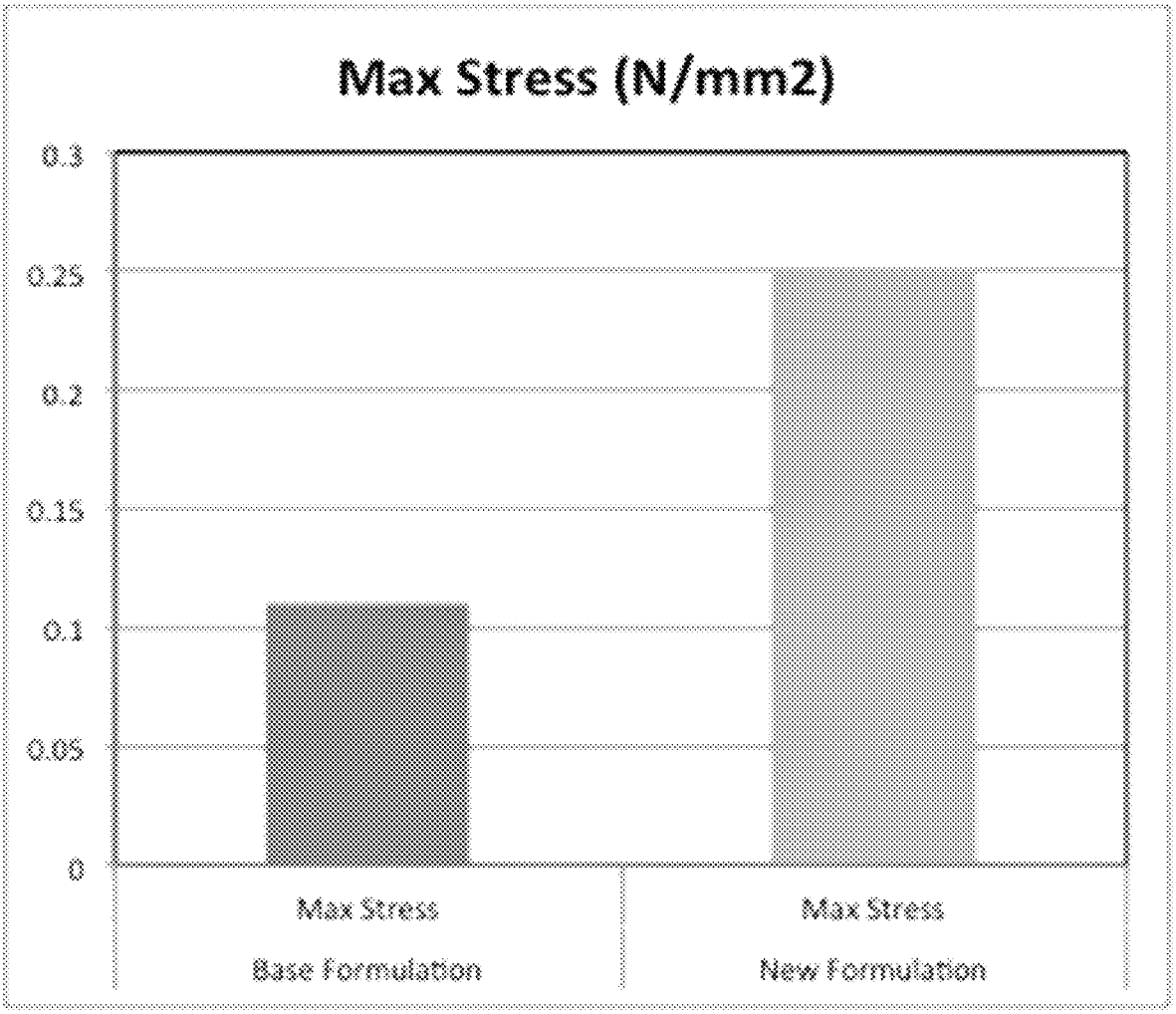
FIG. 7 shows a plot of the results of table 2.
Figure 8:
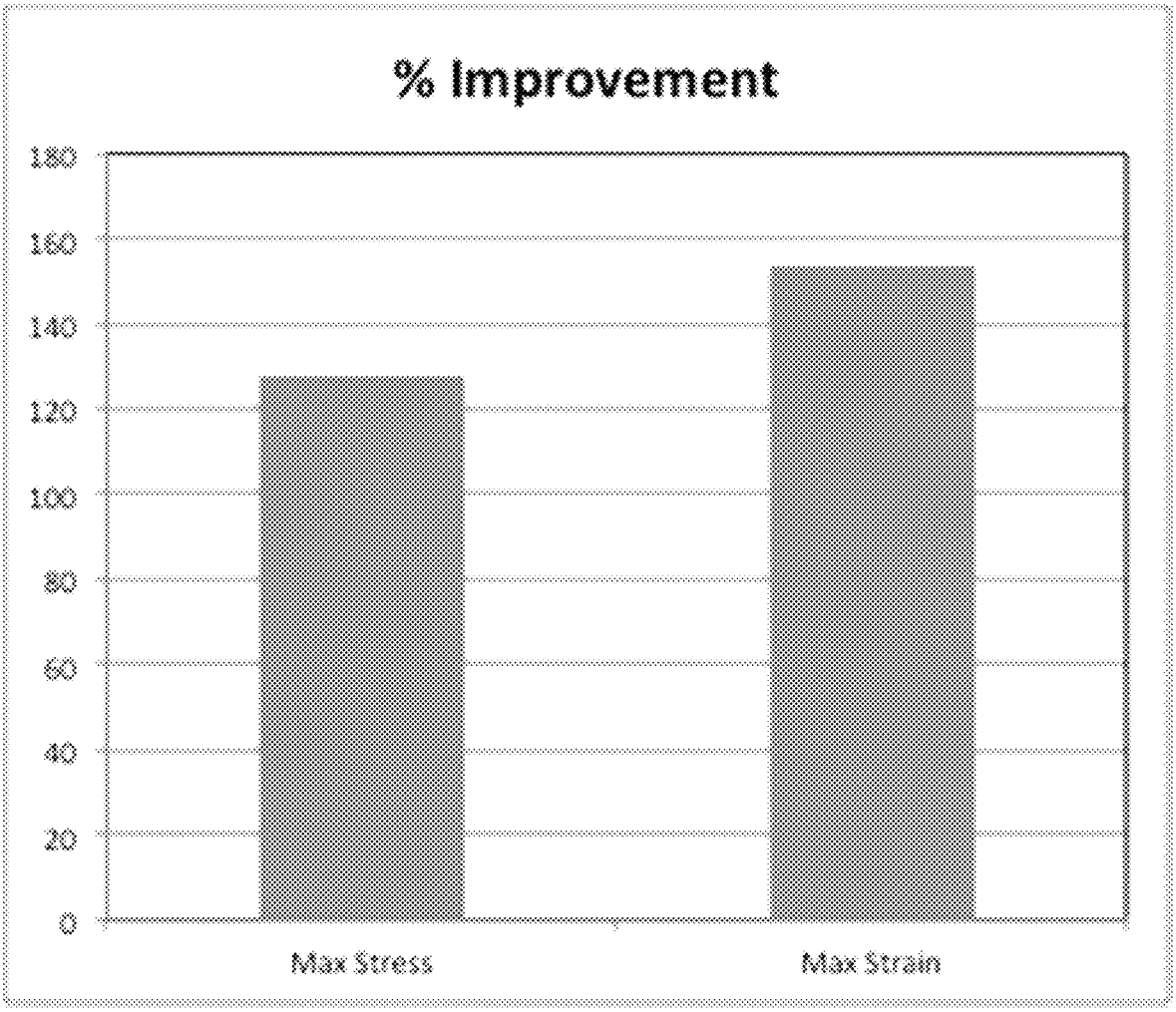
FIG. 8 shows a plot of the results of table 2.

These results are plotted in FIGS. 7 and 8.

Figure 9:
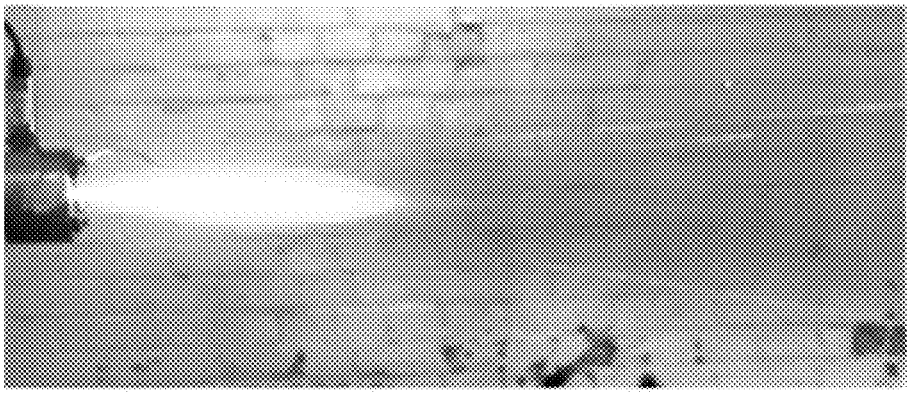
FIG. 9 shows the results with Formulation 3 (8.2 mm diameter throat).
Figure 10:
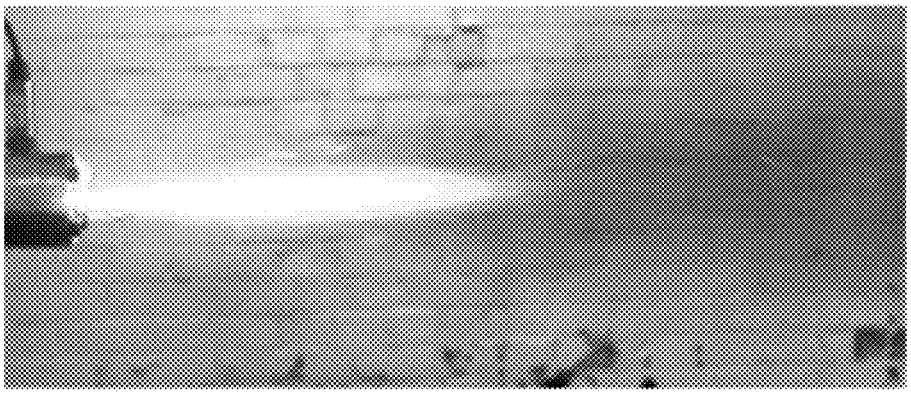
FIG. 10 shows the results with the propellant formulations of this invention (9.5 mm diameter throat).
Figure 11:
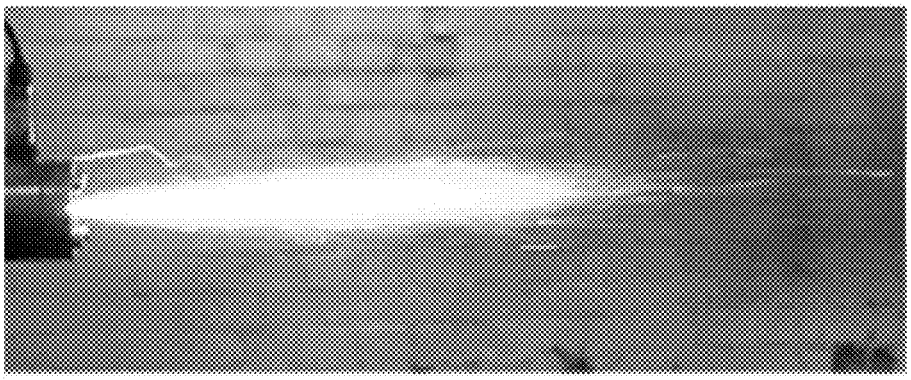
FIG. 11 shows the results with the propellant formulations of this invention.

Rocket Firing Test used to fire a rocket:

Formulations 3 and 4 were fired and FIGS. 9, 10 and 11 show the result with the conventional propellant formulation (Formulation 3) in FIG. 9 and FIGS. 10 and 11 show the results with the propellant formulations of this invention.

Example 3

Mechanical Properties of the Polymer Binder with and without the Low Molecular Weight Resin. Tensile Measurements.

The advantages of adding the low molecular weight resin, is also apparent when the mechanical properties of the cross-linked polymer binder is examined alone.

The polybutadiene (R45 HTLO pre-cured polymer binder as used in Formulations 1 and 2) was used alone and also blended with 5% (w/w) Tall Oil Rosin Ester (TORE) (Trade name: Dercol PE 100). The two polymer samples were placed into a tensile bar mould with a Reduced Section of 4 mm×4 mm. The cross-linking agent was isophorone diisocyanate. The polymer was cross-linked to a theoretical value of 85%.

The results are shown in Table 3 and in each case the tackifying resin improves the stress and strain performance of the cross-linked polymer.

TABLE 3

| Binder Composition | Pull Rate (mm/min) | Elongation at Break $\varepsilon_B$ (%) | RE Improvement $\varepsilon_B$ (%) | Stress at Break $\sigma_B$ (Mpa) | RE Improvement $\sigma_B$ (%) |
|---|---|---|---|---|---|
| HTLO | 10 | 147 | | 1.35 | |
| HTLO + RE | 10 | 200 | 36.1 | 1.37 | 1.5 |
| HTLO | 100 | 261 | | 0.202 | |
| HTLO + RE | 100 | 340 | 30.3 | 0.259 | 28.2 |

Example 4

Rocket Motor Firing of Propellant Containing Tackifying Resin.

The firing of two rocket motors containing one with an 8.2 mm diameter nozzle throat (K-Round 004) and the other with a 9.5 mm diameter nozzle throat (K-Round 005) using the energetic formulation set out below were performed in K-Round motors.

The Formulation

Binder: R45 HTLO with 10% RE: 15%

Plasticiser: DOA: 4.5%

Fuel: Aluminium Powder: 4.0%

Fuel: Zinc Powder: 2.0%

Burning rate modifier: Iron Oxide: 0.54%

The K-Round is a double cone and cylinder charge designed to give a neutral burning surface area. It has a simple sonic nozzle Oxidiser: AP: 72.86%

Curing agent: IPDI: 1.1% (Cured to 0.85 placed in oven at 60° C. for 8 days)

Figure 12:
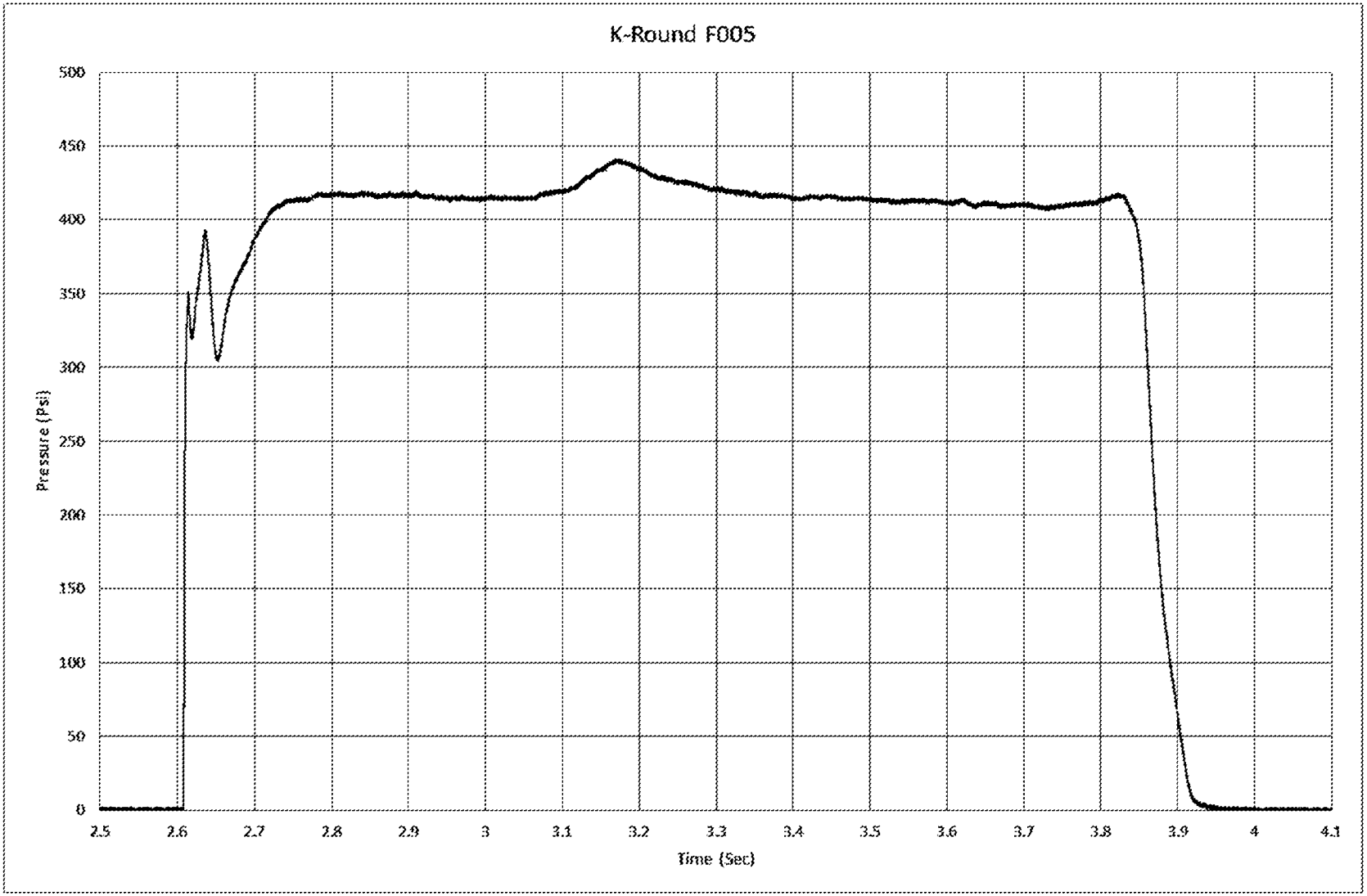
FIG. 12 shows that the charges burn in a stable manner and are thus suitable for rocket motors.
Figure 13:
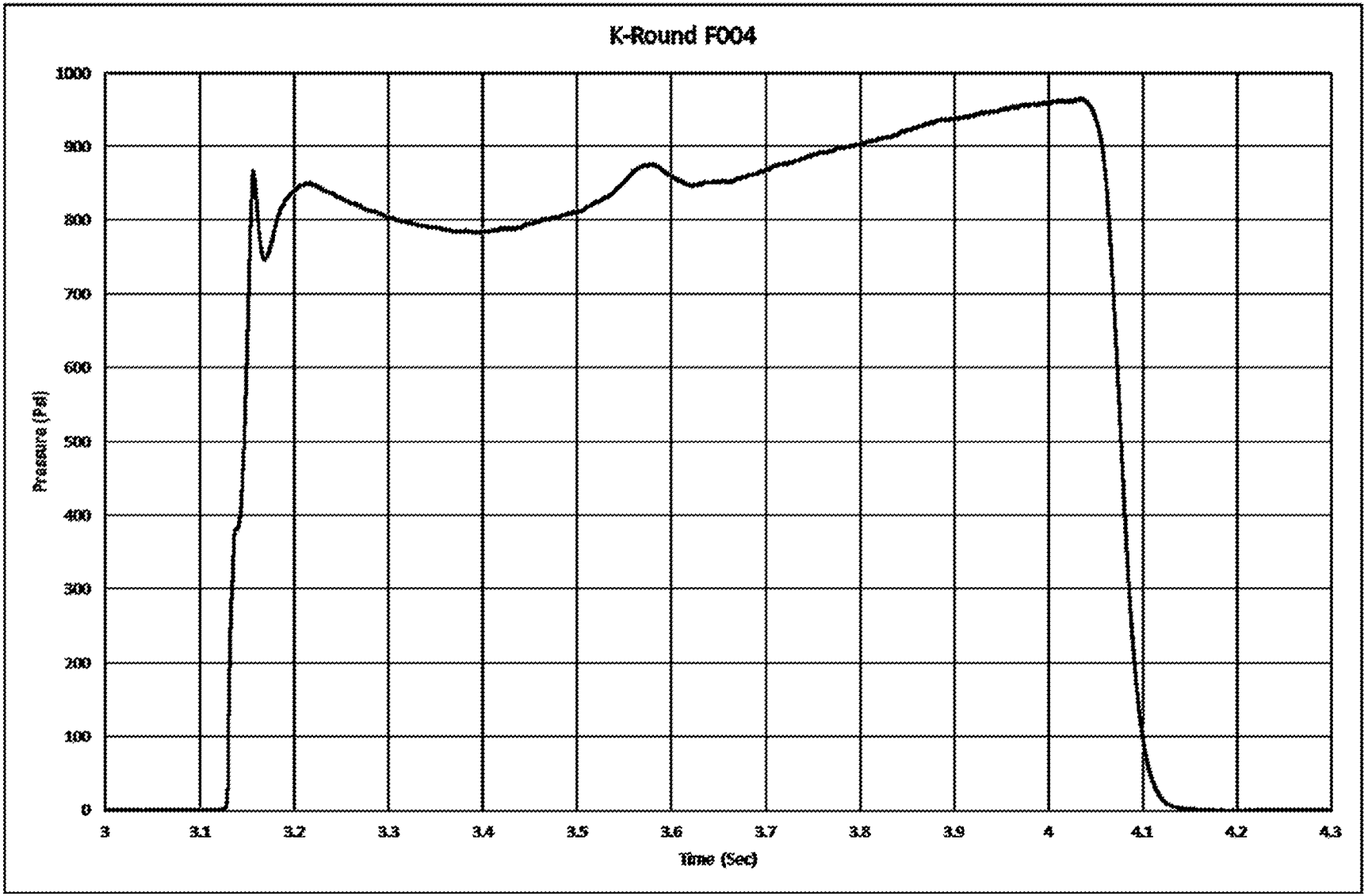
FIG. 13 shows that the charges burn in a stable manner and are thus suitable for rocket motors.

The results are shown in FIGS. 9 (8.2 mm diameter throat) and 10 (9.5 mm diameter throat). FIGS. 12 and 13 show that the charges burn in a stable manner and are thus suitable for rocket motors.

Figure 14:
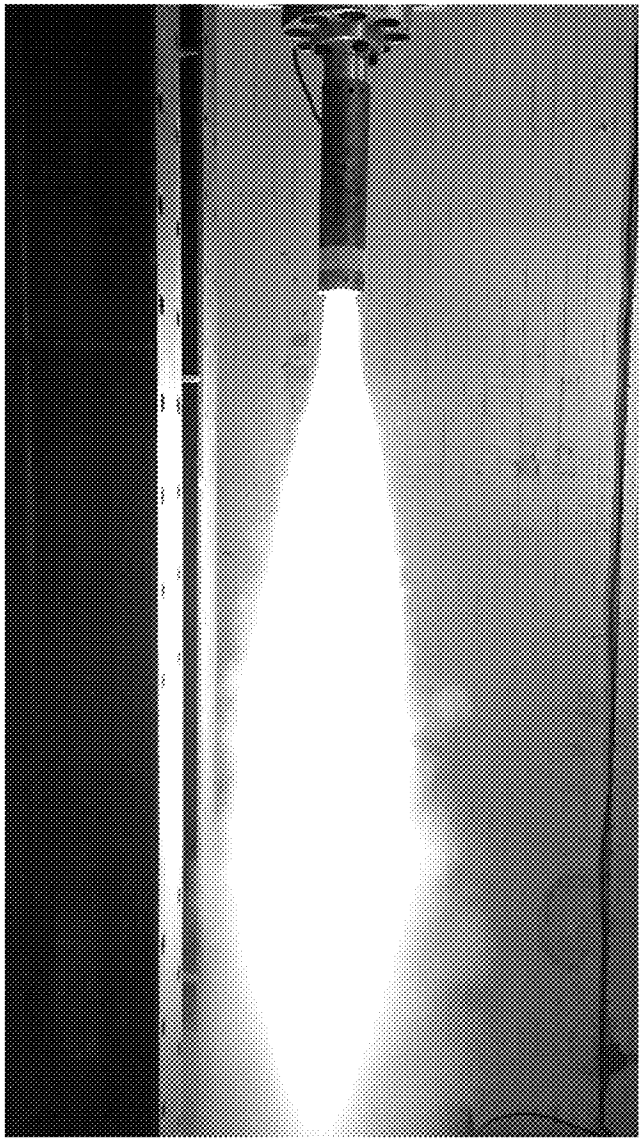
FIG. 14 shows the actual firing of the 8.2 mm diameter throat.

The actual firing of the 8.2 mm diameter throat is shown in FIG. 14.

The invention claimed is:

1. An energetic material formulation containing:

a binder polymer, a tackifying resin, which decreases a degree of entanglement of the binder polymer, and a separate cross-linking agent, which chemically cross-links the binder polymer;

wherein the tackifying resin is miscible with the binder polymer; and wherein the binder polymer has functional terminal groups and/or functional pendant groups to enable chemical cross linking of the binder polymer by the separate cross-linking agent.

2. The energetic material formulation according to claim 1, further comprising an active component.

3. The energetic material formulation of claim 1, wherein the binder polymer is a polybutadiene or a polybutadiene copolymer.

4. The energetic material formulation of claim 3, wherein the cross-linking agent is a multi-isocyanate.

5. The energetic material formulation of claim 4, wherein the energetic material formulation comprises a plasticizer in an amount of about less than 10% by weight.

6. The energetic material formulation according to claim 5, wherein the binder polymer is hydroxy terminated polybutadiene or carboxyl terminated polybutadiene.

7. The energetic material formulation according to claim 6, wherein the tackifying resin includes a rosin ester.

8. The energetic material formulation according to claim 6, wherein the tackifying resin includes a terpenic resin.

9. The energetic material formulation according to claim 6, wherein the tackifying resin includes a C5 hydrocarbon resin, a C9 hydrocarbon resin, a C5/C9 resin, or a combination thereof.

10. The energetic material formulation according to claim 6, wherein the tackifying resin includes a DCPD-based resin, a DCPD-based/C9 hydrocarbon resin, or both.

11. The energetic material formulation according to claim 1, in which a ratio of the binder polymer and the tackifying resin is from 95:5 to 20:80.

12. The energetic material formulation according to claim 11, wherein an amount of the binder polymer and the tackifying resin is from 5:95 to 40:60 of a total amount of other components in the energetic material formulation.

13. The energetic material formulation according to claim 2, wherein the active component includes ammonium perchlorate.

14. The energetic material formulation according to claim 1, wherein the energetic material formulation contains a metal fuel.

15. The energetic material formulation according to claim 1, wherein the energetic material formulation is a propellant, a pyrotechnic, a rocket propellant, or an explosive.

16. An energetic material formulation comprising:

one or more active components, a binder polymer, a tackifying resin, which decreases a degree of entanglement of the binder polymer, a separate cross-linking agent, which chemically cross-links the binder polymer;

wherein the tackifying resin is miscible with the binder polymer; and wherein the binder polymer has functional terminal groups and/or functional pendant groups to enable chemical cross linking of the binder polymer by the separate cross-linking agent.

17. The energetic material formulation of claim 16, wherein the tackifying resin improves dispersion of the one or more active components within the binder polymer of the energetic material formulation.

18. The energetic material formulation of claim 17, wherein the tackifying resin is a rosin ester.

19. The energetic material formulation of claim 16, wherein the binder polymer is a polybutadiene or a polybutadiene copolymer.

20. The energetic material formulation of claim 19, wherein the binder polymer is hydroxy terminated polybutadiene or carboxy terminated polybutadiene.

* * * * *